US007014550B2

(12) United States Patent
Mansfield et al.

(10) Patent No.: US 7,014,550 B2
(45) Date of Patent: Mar. 21, 2006

(54) SANDING SYSTEM

(75) Inventors: David J. Mansfield, Ballston Lake, NY (US); Paul A. Krupa, Grand Island, NY (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 10/650,373

(22) Filed: Aug. 28, 2003

(65) Prior Publication Data

US 2004/0038633 A1 Feb. 26, 2004

Related U.S. Application Data

(63) Continuation-in-part of application No. 09/952,932, filed on Sep. 14, 2001, now Pat. No. 6,616,519.

(51) Int. Cl.
*B24D 15/04* (2006.01)

(52) U.S. Cl. ..... 451/512; 451/524

(58) Field of Classification Search ..... 451/512, 451/520, 521, 523, 524, 525, 557, 354; 15/244.1, 15/244.4
See application file for complete search history.

(56) References Cited

U.S. PATENT DOCUMENTS

| | | | | |
|---|---|---|---|---|
| 2,112,593 | A | 3/1938 | Campbell | |
| 2,517,213 | A | 8/1950 | Kautenberg | |
| 3,842,549 | A * | 10/1974 | Johnston | 451/524 |
| 4,023,312 | A | 5/1977 | Stickney | |
| 4,077,083 | A | 3/1978 | Siemund et al. | |
| 4,825,597 | A | 5/1989 | Matechuk | |
| 4,844,967 | A | 7/1989 | Goralski et al. | |
| 5,054,248 | A | 10/1991 | Thayer | |
| 5,172,524 | A | 12/1992 | Poss | |
| 5,337,523 | A * | 8/1994 | Walsh | 451/502 |
| 5,343,586 | A * | 9/1994 | Vosbikian | 15/121 |
| 5,605,500 | A | 2/1997 | Matechuk | |
| 5,864,913 | A | 2/1999 | Robertson et al. | |
| 5,895,316 | A | 4/1999 | Williams | |
| 6,044,513 | A | 4/2000 | Penn | |
| RE37,486 | E | 12/2001 | Stanzione | |
| 6,379,237 | B1 | 4/2002 | Gordon | |
| 6,439,988 | B1 * | 8/2002 | Long et al. | 451/495 |
| 6,524,175 | B1 | 2/2003 | Beaudry et al. | |
| 2001/0000503 | A1 | 4/2001 | Beaudry et al. | |
| 2001/0049257 | A1 | 12/2001 | Schadoffsky et al. | |
| 2002/0034929 | A1 | 3/2002 | Bode | |
| 2002/0144371 | A1 | 10/2002 | Piombini | |

FOREIGN PATENT DOCUMENTS

| | | |
|---|---|---|
| CA | 2246471 | 9/1998 |
| DE | 196 36 474 A1 | 9/1996 |
| DE | 298 04 858 U1 | 3/1998 |
| EP | 0 291 480 B1 | 12/1992 |
| EP | 0 578 865 A1 | 1/1994 |
| FR | 2620367 | 3/1989 |

* cited by examiner

*Primary Examiner*—Robert A. Rose
(74) *Attorney, Agent, or Firm*—Joseph P. Sullivan

(57) ABSTRACT

The invention provides a sanding system comprising a detachable sanding pad with a plurality of sides adapted for different degrees of sanding retained in contact with a backing plate by teeth penetrating into opposed sides of the sanding pad.

19 Claims, 6 Drawing Sheets

SANDING SYSTEM

CROSS REFERENCE TO RELATED APPLICATIONS

This application is a continuation-in-part patent application and claims priority to U.S. patent application Ser. No. 09/952,932 filed on Sep. 14, 2001, now U.S. Pat. No. 6,616,519.

BACKGROUND OF THE INVENTION

This invention relates to a sanding system and specifically to a sanding system comprising a deformable pad with an abrasive surface and a holder means by which the pad may be applied to a surface.

Deformable sanding pads have been described in many different forms. Usually the form of that of a expanded foam material with one or more abrasive surfaces. However the foam has been replaced in some formats by a porous fibrous web comprising filaments with abrasive particles adhered thereto. The key feature is deformability such that the surface can be compressed to conform to a non-planar surface, or so that the pressure applied can be varied to change the amount of sanding performed. The pads can be adapted to provide hand gripping means as in U.S. Pat. No. 3,998,012 where the pad is bulky enough to provide some separation between the sanding surface and the hand gripping the pad. It is also known to back rotary abrasive discs with a deformable support, made from a foam rubber pad or the like. A family of such pads designed to be attached to a holder by a hook and loop attachment means is described in U.S. Pat. No. 5,007,128. Here the pad is used to apply a fine sanding powder or slurry rather than itself having an abrasive surface and the surface has a waffle pattern imposed upon it.

In addition to the above art there are many patents describing holders for abrasive sandpaper sheets such that the sheets are stretched over a surface of a holder so that a surface can be sanded without risking the knuckles of the one holding the sandpaper. Typical among these is U.S. Pat. No. 5,337,523 which describes a corner sander with a handle shaped holder. U.S. Pat. No. 2,112,593 describes a block contoured to be easily grippable and adapted to trap a sheet of sandpaper and stretch it over a flat surface of the block. U.S. Pat. No. 5,168,672 describes a similar device with a rather more complex system for retaining the sheet in place. U.S. Pat. No. 5,662,519 describes a flexible elongated gripping block with a sanding surface adapted to receive and support a sheet of sandpaper attached thereto by a pressure sensitive adhesive or a hook and loop fastener system. Other patents describing a system with an associated gripping means include U.S. Pat. No. 2,280,767 (where the abrading means is provided by abrasive blocks), U.S. Pat. Nos. 5,512,010; 5,383,308; 5,172,524; 5,054,248; 2,400,928; 1,844,996; 1,599,906; and 1,067,280.

However the sytems providing a holder usually have a substantially rigid support for a sheet of sandpaper or else an extension of a foam block providing the gripping means. Mechanical gripping of a deformable pad is not straightforward precisely because it is deformable. In use the retention of the pad within the holder becomes difficult as the intensity of the sanding increases. In addition making the abrasive pad deformable and giving it an abrasive surface implies that the pad is to be thrown away after use thereby adding to the cost significantly.

A sanding system has now been devised in which the sanding pad is deformable and yet can be retained in a holder securely, and which can provide a plurality of abrading surfaces. Moreover the retention means does no damage to the abrading surfaces meaning that the pad can be removed and replaced a plurality of times without compromising the security with which the pad is held.

GENERAL DESCRIPTION OF THE INVENTION

In one embodiment, the present invention provides a sanding system comprising:

a) a relatively rigid rectangular backing plate having first and second opposed surfaces and provided on said first surface with a handle and, on said second surface, means to support a sanding pad, and having a pair of opposed parallel ends with at least one attachment means on said first surface adjacent at least one of said parallel ends;

b) a deformable sanding pad with rectangular dimensions similar to those of the backing plate and a thickness that is not greater than the shorter of the rectangular dimensions and having at least one sanding surface; and c) at least one retaining means adapted at one end to pierce opposed sides of the deformable sanding pad in the thickness dimension and at the other to be releasably secured to the attachment means.

In another embodiment, the present invention provides a sanding system comprising:

a) a relatively rigid rectangular backing plate having a pair of opposed parallel ends and first and second opposed surfaces, and provided on said first surface with a handle and means to support a sanding pad on said second surface;

b) a deformable sanding pad with rectangular dimensions similar to those of the backing plate and a thickness that is not greater than the shorter of the rectangular dimensions and having at least one sanding surface, wherein the sanding pad further comprises a pair of opposed parallel ends and at least one of the pair of parallel ends comprises a groove; and c) at least one retaining means in communication with the backing plate having a generally L-shaped cross section with a plurality of projections extending from an end of the generally L-shaped cross section adapted at one end to pierce a side of the deformable sanding pad in the thickness direction through at least a portion of the groove.

The active surfaces of the deformable pad are referred to as "sanding surfaces" and in the context of this application, the term is intended to embrace surfaces adapted to move a loose abrasive powder or a slurry of such a powder against a substrate surface, such as might be appropriate in a polishing or buffing operation, as well as conventional sanding in which the surface is provided with abrasive grain fixed in location with respect to the surface and intended for polishing or material removal from the substrate.

The deformable sanding pad preferably has parallel first and second opposed surfaces with each provided with a sanding surface, preferably with different sanding qualities. It is also possible to provide that two of the opposed surfaces representing the thickness or side surfaces of the pad be also adapted for sanding. Normally these side surfaces are smaller than the opposed major surfaces but it is also within the purview of the invention to provide that the pad has a thickness dimension such that at least two pairs of opposed side surfaces are substantially equivalent in size to the rectangular backing plate such that four out of the six sides have similar dimensions and are provided with sanding surfaces. The remaining pair of opposed surfaces are preferable not adapted for sanding since, in use, these cooperate with the retaining means to attach the pad to the backing plate. One or both of the remaining pair of opposed surfaces can also have grooves to provide a more secure connection between the pad and the retaining means connected to the backing plate. The sanding surfaces of the pad can be provided with abrasive grits of the same fineness but it is often preferable to have sanding surfaces having at least two different grit sizes such that for example, by changing the mounting of the pad to the backing plate it is possible to go from a coarse sanding surface to a finer in one or more steps, simply by changing the orientation of the pad with respect to the backing plate.

The material from which the sanding pad is made is deformable but preferably resilient so that it can be conformed to a variety of surfaces. The preferred material is a foam such as an open-celled polyurethane foam though open or closed cell foams of other polymeric materials such as natural or synthetic rubber, PVC, polyolefins and the like can be substituted. The actual surface can be planar and this is the preferred embodiment when the surface comprises fixed abrasive grits. However when the surface is adapted for use with loose or slurried abrasive particles the surface may be contoured, (as for example by providing a waffled or a wavy surface), with different degrees of resilience. This can be achieved by having foams of different densities or degrees of contouring providing each surface.

Where the sanding pad is subjected to significant deformation pressures during use it can be advantageous to incorporate into the sanding pad a strengthening member to help it retain its structural integrity. This may take the form of a core of relatively dense but flexible material such as a rubber, or a reinforcing relatively rigid layer adhered, for example by a pressure sensitive adhesive, to the surface of the sanding pad in contact with the backing plate.

Pads for polishing applications often have surfaces with a relatively high level of conformability, that is to say, they are often readily deformable to conform to the surface being sanded to avoid excessive pressure being applied to one spot by comparison with an adjacent spot.

The surface of the pad which contacts the workpiece can be planar or contoured with the latter being preferred where it may be desired to polish lightly with only a portion of the surface in contact with the workpiece or, more vigorously, compressed so essentially all the foam surface contacts the workpiece.

The backing plate can be made of any suitable rigid material such as metal or plastic or wood. Generally for ease of forming and expense, plastic is the preferred material and the plate is readily formed by an injection molding technique from a thermoplastic polymer such as high-impact polystyrene, ABS, polyolefin or nylon. The backing plate is preferably molded with an integral handle and anchor points for the retaining means. In other embodiments, the retaining means can be integral with the backing plate. In another embodiment, the handle can however be separately formed and be detachable. In yet another embodiment, the handle can be replaced with a pole sanding mechanism. The backing plate can be the same size as the sanding pad attached thereto but often it is preferred that the backing plate be slightly narrower than the sanding pad such that it is possible to sand right up to a surface at right angles to the surface being sanded. This is especially useful where the sides of the sanding pad are likewise adapted for sanding.

A typical backing plate has a rectangular structure but this is understood to embrace also a square configuration. In one embodiment, the plate has two opposed parallel ends provided with mounting means on which the retaining members will be mounted. In another embodiment, the retaining members are integrally formed proximate the opposite parallel ends of the backing plate. It is also possible to provide that the sides at right angles to the ends having the mounting means are provided with short extensions to give lateral support to the sanding pad during use. These may extend the full length of the sides or may rather have the form of short tabs at intervals along the sides. Such extensions however can interfere with sanding a surface close to a surface at right angles to the surface being sanded and for that reason are less preferred features.

The mounting means can be provided by a simple spring clip device cooperating with a mounting lip on and preferably integral with the backing plate. Such a clip can also be made attachable to the backing plate. Alternatively the mounting means can comprise a screw shaft molded into the backing plate that is adapted to project through a cooperating hole in the retaining member and receive a nut to anchor the retaining member. Another form of mounting means can be provided by a slot adapted to releasably retain a bayonet projection on a retaining member.

The retaining member itself has an L-shaped cross-section having a plurality of teeth projecting from a point adjacent one end of the L and adjacent the opposed end of the L, means for attaching the retaining member to the mounting means on the backing plate. This attachment means can be a simple as a hole sized to cooperate with a screw shaft mounting means on the backing plate. Alternatively it could comprise one or more projections adapted to cooperate in releasable fashion with one or more slots formed into the backing plate. A preferred form of attachment means is provided by a clamp adapted to bear down on a surface of the retaining member that is in contact with the first surface of the backing plate when a nut mounted on the mounting means is tightened. In another embodiment, the retaining member can have a generally L-shaped cross-section to match a portion of a contour of a groove in the sanding pad.

Typically there are two retaining members located one on each of the opposed ends of the backing plate but as a practical matter one retaining member can be made integral with the backing plate such that no associated mounting means need be associated with that retaining member. In other embodiments, the two retaining members can be integral with the backing plate. In other embodiments, one retaining member can be integral and the other retaining member can be attached. In yet other embodiment, only one retaining member can be used to attach the pad to the backing plate.

The sanding surface, where this is provided with fixed abrasives, can comprise abrasive grits adhered directly to the surface or alternatively can be provided by a sheet of coated abrasive comprising abrasive grits bonded to a backing material which itself is adhered to the sanding pad. This adhesion can be for example by means of a pressure sensitive adhesive or by a hook and loop type fastener. The abrasive grits themselves can be fused or sintered alumina, alumina/zirconia, silicon carbide or any other commercially available particulate abrading material. The bond by which the grits are held can be a thermosetting resin or an energy-curable resin such as one cured by application of heat or radiation.

DESCRIPTION OF PREFERRED EMBODIMENTS

The invention is now described in terms of the embodiments illustrated in FIGS. 1–4. It is understood that other embodiments of the invention which differ from those illustrated are possible without departing from the essence of the invention.

Figure 1:
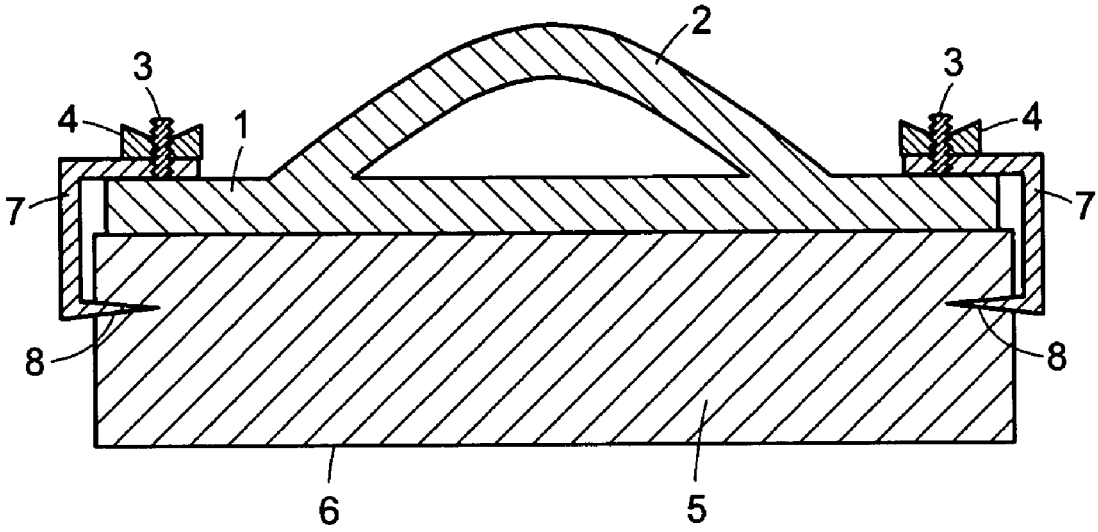
FIG. 1 shows a cross-section of one side of a sanding system according to the invention.
Figure 2:
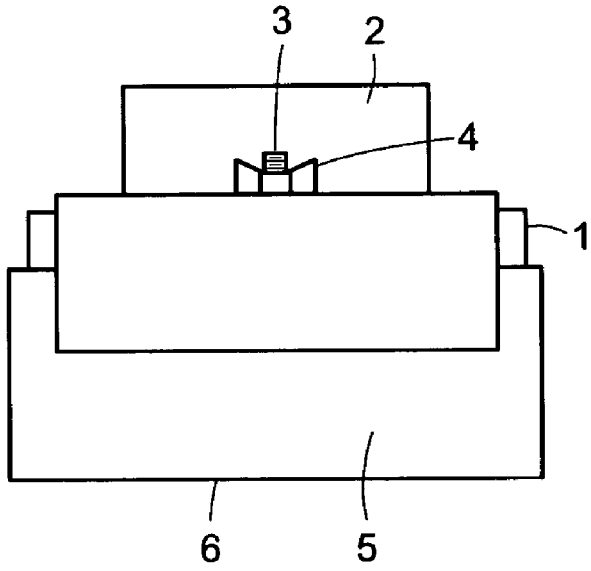
FIG. 2 shows a top view of the sanding system shown in FIG. 1.

In FIGS. 1 and 2 of the drawings, a rectangular backing pad 1, provided with an integrally molded handle, 2, is provided, at points adjacent two opposed ends, with two screw shafts, 3, molded into and projecting perpendicular to the plane of the backing pad. A rectangular foam sanding pad, 5, having at least one abrasive surface, 6, contacts the backing pad and is retained in contact therewith by retaining members, 7, having an L-shaped cross-section with teeth, 8, adjacent one end which penetrate the sanding pad. At the opposed end of the retaining member a hole, 4, fits over the screw shaft, 3, and the retaining member is secured in position by a wing nut, 9.

To mount the pad it is only necessary to place the pad in contact with the backing plate and the drive the teeth of the retaining member into the body of the foam at each end and secure the retaining members on the attachment means using the wing nuts. When the sanding surface needs to be changed, the retaining members are removed and the pad is rotated to place a new surface of the pad in position to sand a workpiece surface and the retaining members are replaced.

Figure 3:
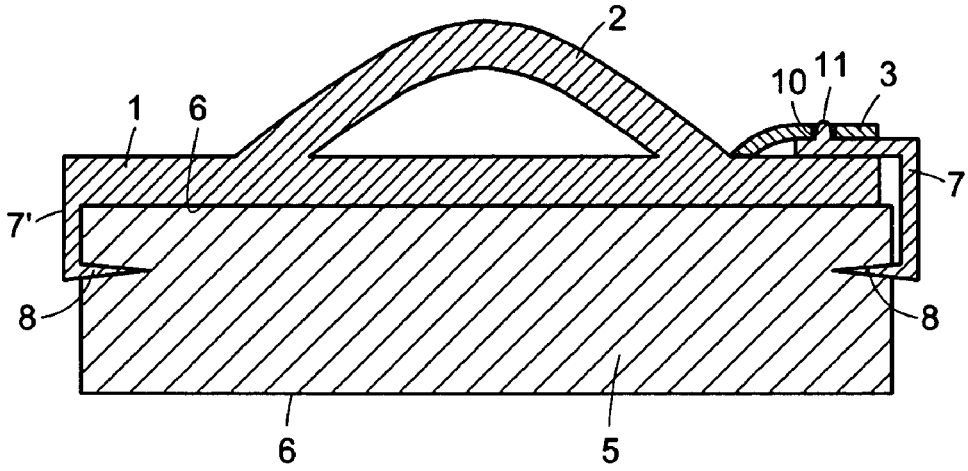
FIG. 3 shows a cross-section of one side of a second design of sanding system according to the invention.
Figure 4:
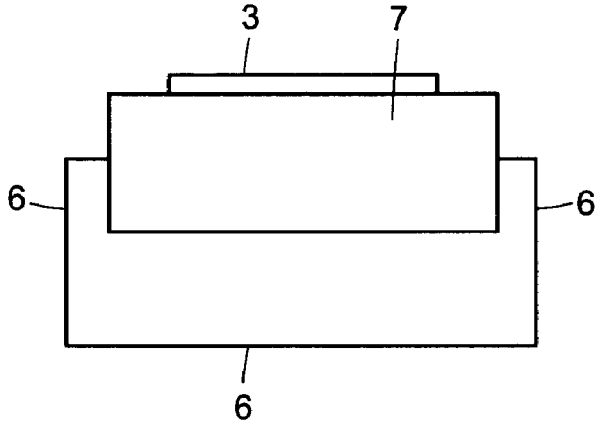
FIG. 4 shows an end view of the sanding system pad shown in FIG. 3
Figure 5:
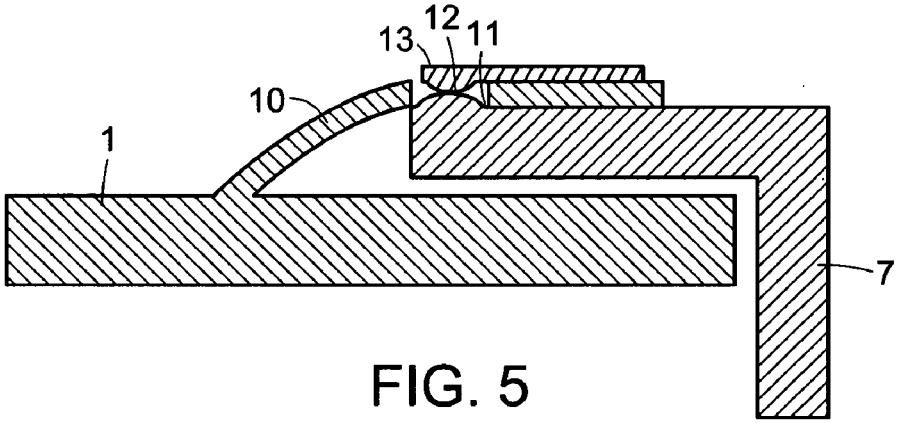
FIG. 5 shows a cross-section of an alternative form of mounting means.

FIGS. 3 and 4 illustrate two further variations on the design illustrated in FIGS. 1 and 2. In this design one retaining member, 7' is an integral extension of the backing plate, provided with teeth, 8, to penetrate and hold the pad, 5 in position. The pad itself has a square cross-section with four equal sides each provided with a sanding surface, 6. The removable retaining member, 7, is adapted to cooperate with a slotted structure, 10, on the backing plate in which the end of the retaining member, 11, is releasably held. This means of releasably holding the retaining member is more clearly illustrated in FIG. 5 which shows an enlargement of the means used in FIG. 3. The end of the retaining member 11, is provided with a button projection, 12, and the slotted structure, 10, has a hole through which the button projects when the retaining member is in position preventing removal of the retaining member. A spring, 12, is provided to depress the button projection when it is desired to remove the retaining member.

Figure 6A:
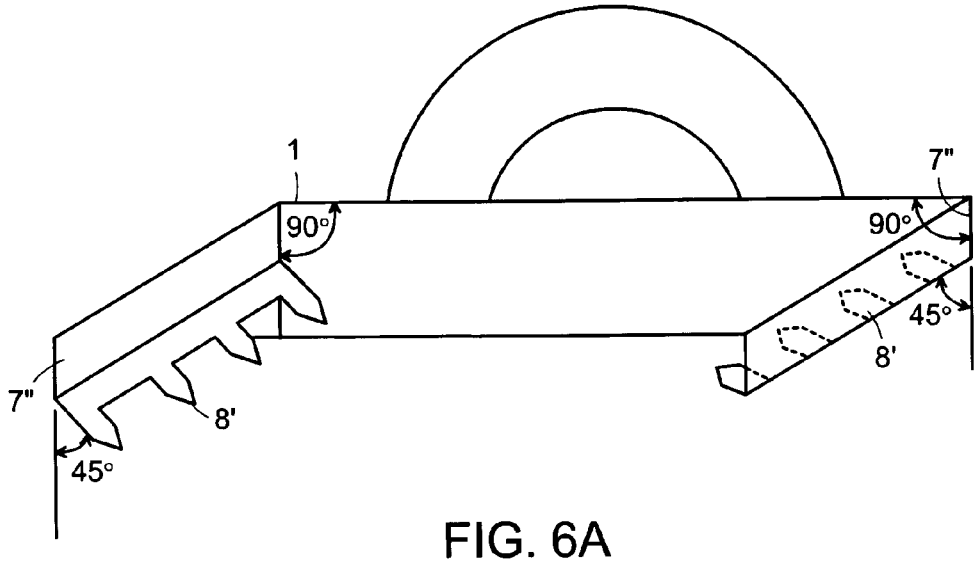
FIG. 6A shows a perspective view of yet another alternative form of mounting means.
Figure 6B:
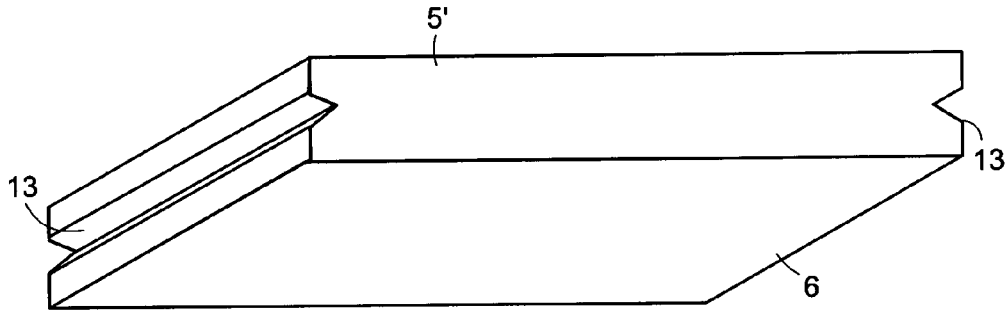
FIG. 6B shows a perspective view of another embodiment of a sanding pad.

FIGS. 6A and 6B illustrate other further variation on the design illustrated in FIGS. 1 and 2. In this design two retaining members 7", which are generally L-shaped and can be an integral extension of the backing plate, are provided with teeth 8' to penetrate and hold a pad 5' in position. The pad 5' further includes grooves 13 to provide a stronger connection between the retaining member 7" and the pad 5' by allowing at least a portion of the retaining member 7" to be generally parallel with at least a portion of groove 13. In one embodiment, the teeth 8' are parallel to backing plate 1. In another embodiment, the teeth 8' extend from the retaining member 7" to continue in the general L-shape of the retaining member 7". The pad itself has a rectangular cross-section having at least one sanding surface 6. As both retaining members 7" are integral, the pad 5' would be installed by stabbing one set of teeth 8' into one groove 13, and deforming the pad 5' to allow the groove 13 on the other side of the pad 5' to be stabbed by the other set of teeth 8'.

Figure 7A:
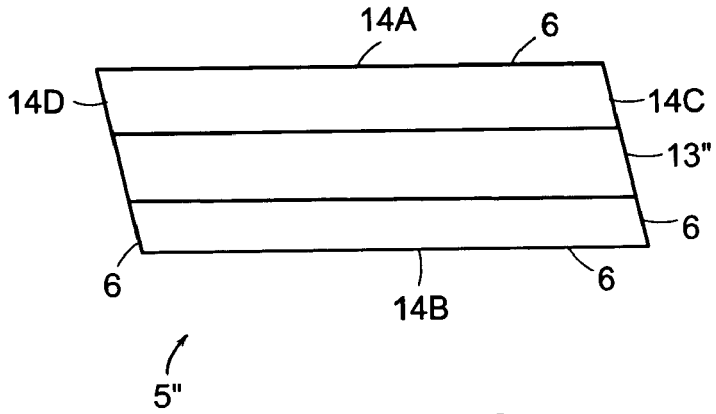
FIG. 7A shows a side view of a sanding pad comprising a groove where the first opposed surface and the second opposed surface are offset.
Figure 7B:
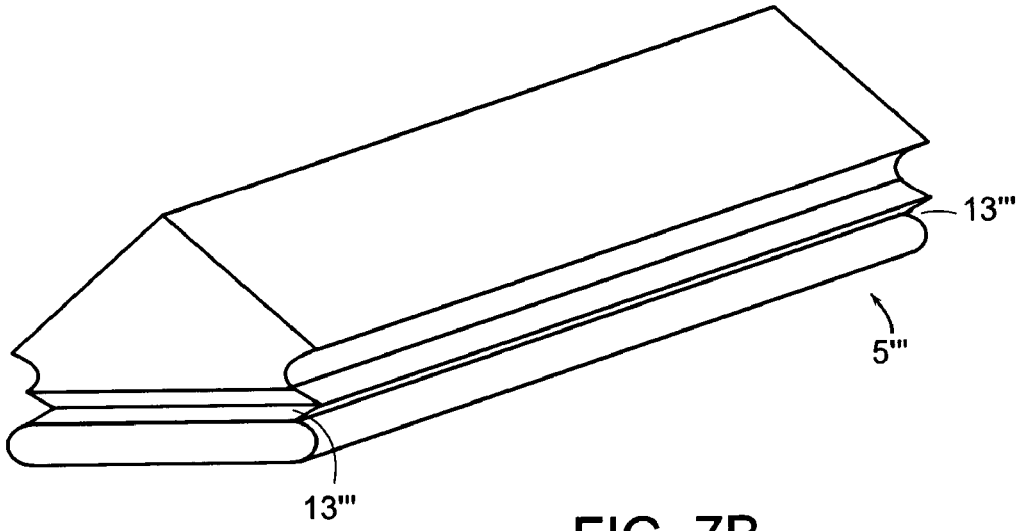
FIG. 7B shows a perspective view of a sanding pad comprising a groove where a portion of the pad under the groove is triangular-shaped.
Figure 7C:
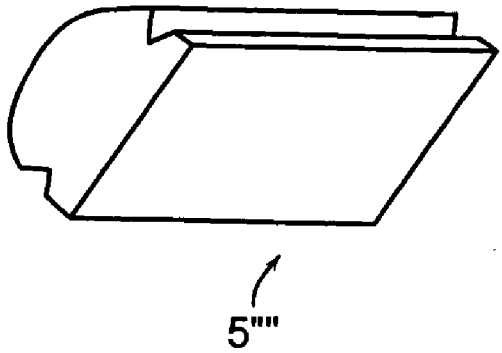
FIG. 7C shows a perspective view of a sanding pad comprising a groove where a portion of the pad under the groove is bulbous-shaped.

In other embodiments, a portion of the pad under the groove can be any geometric shape required for sanding a given work piece. For example, FIG. 7A shows a side view facing the groove 13" of another embodiment of the sanding pad 5", where a first opposed surface 14A and a second opposed surface 14B of the pad 5" are offset. The offset of the first opposed surface 14A and the second opposed surface 14B results in a trapezoidal shape of the pad 5". The first opposed surface 14A and the second opposed surface 14B, as well as the surfaces in the thickness direction without the groove 14C and 14D have abrasive surfaces 6. Each of the abrasive surfaces 6 of pad 5" may have different sanding qualities. The trapezoidal shape of pad 5" allows the pad 5" to abrade work surfaces that have limited access areas such as tight corners. In another embodiment, as shown in FIG. 7B, a portion of the pad 5'" under the groove is triangular-shaped. In yet another embodiment, as shown in FIG. 7C, a portion of the pad 5"" is bulbous-shaped. The portion of the pad under the groove can be any geometric shape desired to meet a particular abrading need.

Figure 7D:
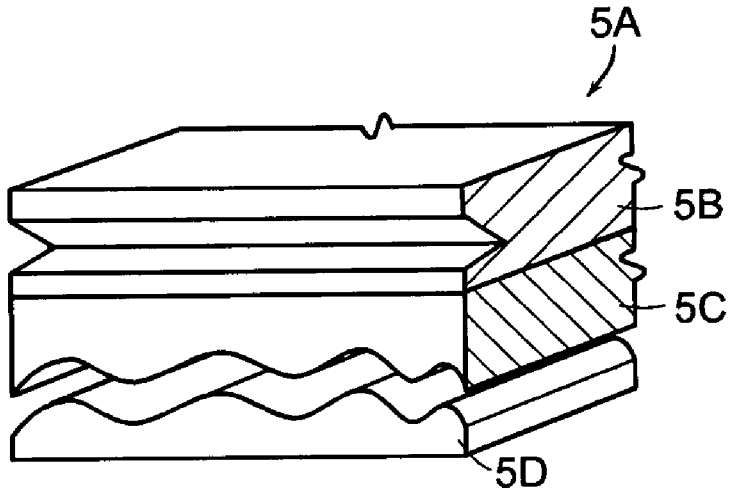
FIG. 7D shows a perspective view of half a sanding pad comprising a groove where the pad is made of a first material and a second material.

For work pieces that require a lighter amount of force, FIG. 7D shows half a pad 5A that is a composite pad made of a first material 5B and second material 5C. The first material would be more rigid than the second material to provide proper support between the pad and the backing pad (not shown). The second material is less rigid than the first material to allow the second material to confirm to the work piece 5D during sanding as illustrated in FIG. 7D. The two materials for the composite pad can be the same materials mentioned above, but the properties for the first material and the second material are selected so the first material provides proper support with the backing plate and so the second material can conform to the work piece.

Figure 8A:
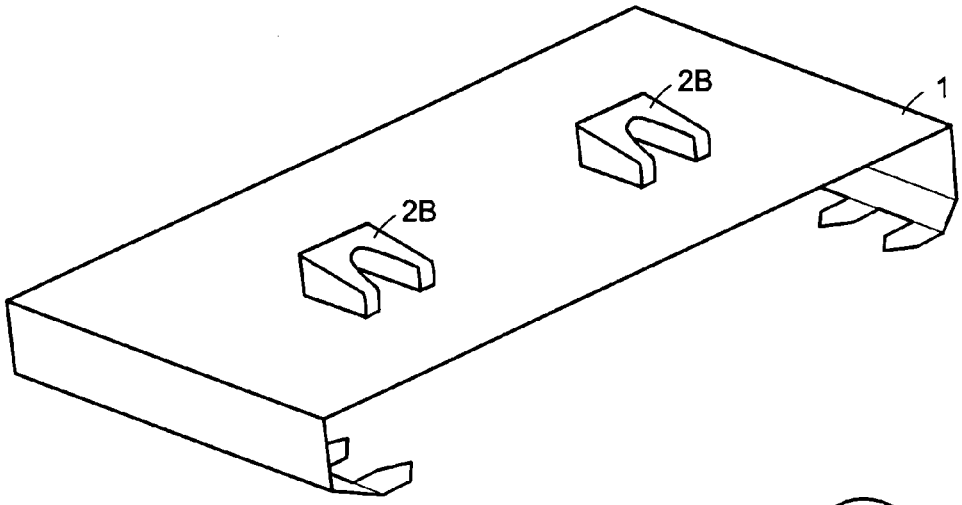
FIG. 8A shows a perspective view of a sanding system according to the invention with a mating structures for accepting a detachable handle.
Figure 8B:
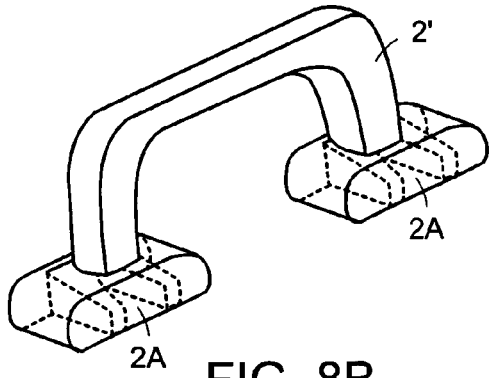
FIG. 8B shows a perspective view of a detachable handle for use with a sanding system.

FIG. 8A illustrates another embodiment of the design illustrated in FIGS. 1 and 2 where a detachable handle 2' in FIG. 8B with mating structures 2A can be attached to backing pad 1 via mating structures 2B.

Figure 9:
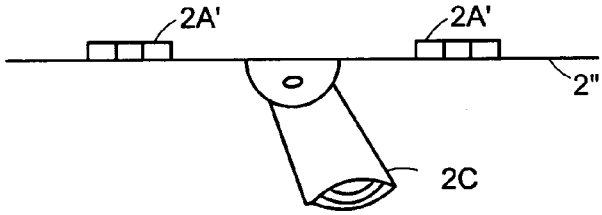
FIG. 9 shows a perspective view of a detachable pole sander mechanism for use with the sanding system according to the invention.

FIG. 9 illustrates another embodiment of the design illustrated in FIGS. 1 and 2, where a pole sander mechanism 2" with mating structure 2A' can be attached to the rectangular backing pad 1 of FIG. 8 via mating structures 2B. The pole sander mechanism allows a pole (not shown) with a threaded end to be screwed onto a pole acceptor 2C of the pole sander mechanism 2" to allow the sanding system to be used on hard to reach surfaces such as a high ceiling.

While the invention has been particularly shown and described with reference to specific preferred embodiments, it should be understood by those skilled in the art that various changes in form and detail may be made therein without departing from the spirit and scope of the invention as defined by the appended claims.

We claim:

1. A sanding system comprising:

a) a relatively rigid rectangular backing plate having a pair of opposed parallel ends and first and second opposed surfaces, and provided on said first surface with a handle and means to support a sanding pad on said second surface;

b) a deformable sanding pad having rectangular dimensions similar to those of the backing plate and a thickness that is not greater than the shorter of the rectangular dimensions, having abrasive grains adhered to the pad thereby forming at least one sanding surface, and having a pair of opposed parallel ends wherein at least one of the pair of parallel ends comprises a groove; and c) at least one retaining member in communication with the backing plate having a generally L-shaped cross section with a plurality of projections extending from an end of the generally L-shaped cross section adapted at one end to pierce a side of the deformable sanding pad in the thickness direction through at least a portion of the groove.

2. The sanding system according to claim 1 in which the sanding pad is formed from a resilient open-celled foam.

3. The sanding system according to claim 1 in which the sanding pad is formed from a polyurethane foam.

4. The sanding system according to claim 1 wherein at least a portion of the generally L-shaped cross section of the at least one retaining member is generally parallel with at least a portion of the groove in the sanding pad.

5. The sanding system according to claim 1 in which the sanding pad has from two to four sanding surfaces.

6. The sanding system according to claim 5 in which the sanding surfaces of the sanding pad have different sanding characteristics.

7. The sanding system according to claim 1 in which the at least one retaining member is formed integrally with the backing plate.

8. The sanding system according to claim 1 in which there are two retaining members.

9. The sanding system according to claim 1 wherein the handle is detachable.

10. The sanding system according to claim 9 wherein the detachable handle is replaced with a pole sanding mechanism.

11. A pad for a sanding system for sanding a surface, the sanding system having a relatively rigid rectangular backing plate having a pair of opposed parallel ends and first and second opposed surfaces and provided on said first surface with a handle and means to support a sanding pad on said second surface, and at least one retaining member in communication with the backing plate having a generally L-shaped cross section with a plurality of projection extending from an end of the generally L-shaped cross section, the pad comprising:

a) rectangular dimensions similar to those of the backing plate;

b) a thickness that is not greater than the shorter of the rectangular dimensions;

c) abrasive grains adhered to the pad thereby forming at least one sanding surface; and d) a pair of opposed parallel ends wherein at least one of the pair of parallel ends comprises a groove.

12. The pad according to claim 11 in which the pad is formed from a resilient open-celled foam.

13. The pad according to claim 11 in which the pad is formed from a polyurethane foam.

14. The pad according to claim 11 in which the pad has from two to four sanding surfaces.

15. The pad according to claim 14 in which the sanding surfaces of the sanding pad have different sanding characteristics.

16. The pad according to claim 11 in which the sanding system comprises two retaining members and both parallel ends of the pad comprise a groove.

17. The pad according to claim 11 in which the pad has a first opposed surface and a second opposed surface offset from the first opposed surface forming a trapezoidal shaped pad.

18. The pad according to claim 11 in which a portion of the pad under the groove is any geometric shape.

19. The pad according to claim 11 comprising a first material and a second material.

* * * * *